United States Patent [19]

Piontkowski

[11] 4,320,742

[45] Mar. 23, 1982

[54] DAMPER ADJUSTING MECHANISM

[75] Inventor: Carl F. Piontkowski, Old Saybrook, Conn.

[73] Assignee: C & D Distributors, Inc., Old Saybrook, Conn.

[21] Appl. No.: 144,665

[22] Filed: Apr. 28, 1980

[51] Int. Cl.[3] ..... F23L 3/00

[52] U.S. Cl. ..... 126/289; 126/286

[58] Field of Search ..... 126/285 R, 285 A, 77, 126/78, 81, 75, 286, 287, 290–293, 289, 312

[56] References Cited

U.S. PATENT DOCUMENTS 1,543,630 6/1925 Thomas ..... 126/286

1,967,552 7/1934 Davies ..... 126/285 R 4,180,052 12/1979 Henderson ..... 126/75

4,201,186 5/1980 Paquin ..... 126/285 A

FOREIGN PATENT DOCUMENTS 784695 7/1935 France ..... 126/289

*Primary Examiner*—James C. Yeung

*Attorney, Agent, or Firm*—Fishman and Van Kirk

[57] ABSTRACT

A damper adjusting mechanism is presented wherein the damper is opened and closed by adjusting a rod. This rod is adjusted by the use of grooves which are latched onto the stove's front wall. These grooves are protected from creosote build-up by a shield.

5 Claims, 3 Drawing Figures

DAMPER ADJUSTING MECHANISM

BACKGROUND OF THE INVENTION

This invention generally relates to a damper control for stoves and particularly to such control for a fireplace installed woodburning tove. More particularly, this invention is directed to a damper control which includes a rod which adjusts the damper and a shield which prevents creosote build-up on the rod.

The prior art discloses mechanisms for adjusting the exhaust damper in woodburning stoves. These mechanisms are usually located above or on the upper side of the firebox and, in a fireplace installed stove, adjacent to the fireplace cover panel. The major disadvantage of this type of control is that, because of its position over the firebox, the operating mechanism for the damper becomes hot to the user's touch and its use requires reaching over the firebox.

SUMMARY OF THE INVENTION

The present invention overcomes the above-stated disadvantage of the prior art by locating the adjusting control on the front panel above the firebox door. An apparatus in accordance with the present invention employs a rod attached at one end to the damper and with the other end extended through the firebox wall opposite the fireplace cover panel. By moving this rod in either a first or second direction, the damper is opened and closed. The rod is held in the position commensurate with the desired damper opening by the use of multiple notches which engage the firebox wall. A shield is provided, within the firebox, to prevent creosote build-up in these notches.

BRIEF DESCRIPTION OF THE DRAWING

The present invention may be better understood and its numerous objects and advantages will become apparent to those skilled in the art by reference to the accompanying drawings wherein like reference numerals refer to like elements in several FIGURES and in which.

DESCRIPTION OF THE PREFERRED EMBODIMENT

Figure 1:
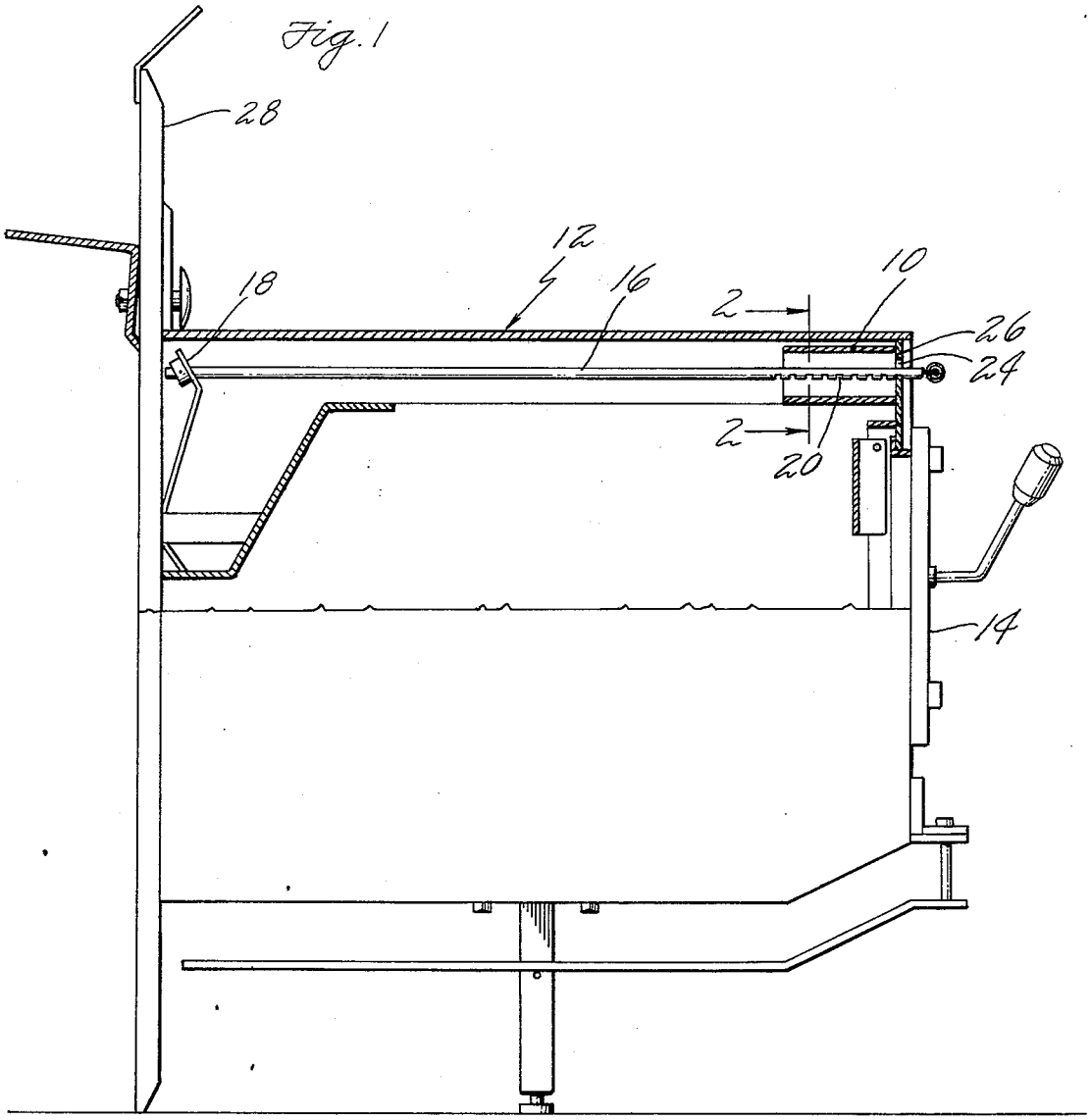
FIG. 1 is a side view of a firebox with the upper portion of the side wall removed so as to expose a damper adjusting mechanism in accordance with a preferred embodiment of the invention.

Referring to FIG. 1, a firebox is indicated generally at 12. Within firebox 12 is a damper adjusting rod 16. The first end of adjusting rod 16 is attached to a damper 18. The second end of rod 16 extends through hole 24 of firebox front wall 26, wall 26 being located opposite a fireplace cover panel 28. The second end of the adjusting rod 16 is positioned just above firebox door 14. Attached to firebox wall 26, within the firebox 12 and surrounding adjusting rod 16, is a creosote shield 10.

Adjusting rod 16 may be moved in a first direction so as to extend a greater length of its second end through hole 24 of firebox wall 26. By moving adjusting rod 16 in a second direction the length of its second end through hole 24 of firebox wall 26 is reduced. The damper 18 is opened by moving adjusting rod 16 in the first direction and is closed by moving adjusting rod 16 in the second direction. Adjusting rod 16 is retained in different positions by means of notches 20 formed therein. The notches 20 have a width greater than the width of the firebox wall 26. By moving the adjusting rod 16 in either a first or second direction, through hole 24, and then by engaging the edge of firebox wall 26, formed by hole 24, into a selected notch 20 the adjusting rod 16 is retained in a desired position so as to retain damper 18 in a closed or open position.

The tubular creosote shield 10 is located within firebox 12 and welded to firebox front wall 26. The shield 10 is preferably coaxial with rod 16 and of rectangular shape with the planes running through the opposite corners of the rectangle being oriented in a crosswise configuration with one plane having a vertical orientation. Shield 10 has sufficient length and is positioned with respect to rod 16 so as to encompass that portion of rod 16 which is provided with notches 20. Shield 10 deters the build-up of creosote within the notches 20 and on the grooved portion of rod 16 whereby damper adjustment is not rendered increasingly difficult with continued stove use.

Figure 2:
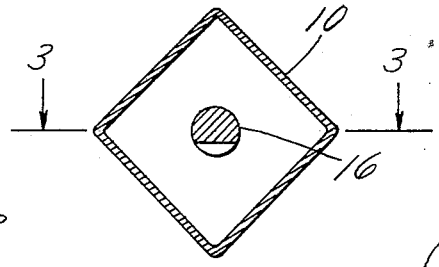
FIG. 2 is a cross-sectional view of the damper adjusting mechanism taken through line 2—2 of FIG. 1.

FIG. 2 is a cross-sectional view of FIG. 1 taken through line 2—2. FIG. 2 shows the above-mentioned configuration of the creosote shield 10 and its positioning so as to encompass the adjusting rod 16. FIG. 2 also shows the dimensions of notches 20 relative to rod 16.

Figure 3:
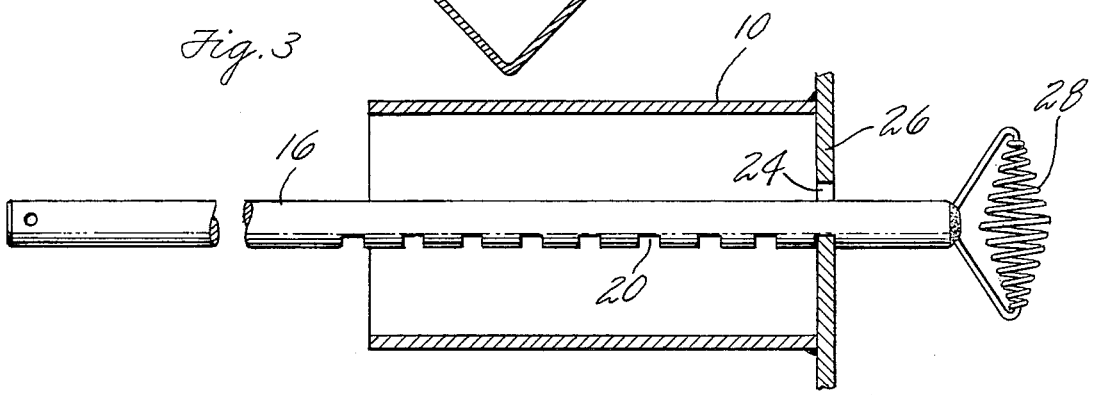
FIG. 3 is a cross-sectional view of the damper adjusting mechanism in FIG. 2 taken through line 3—3 of FIG. 1.

With reference now to FIG. 3, a cross-sectional view of FIG. 2, through line 3—3, depicts the rod 16 within the creosote shield 10.

While a preferred embodiment has been illustrated and described, various modifications and substitutions may be made thereto without departing from the spirit and scope of the invention. Accordingly, it will be understood that the present invention has been described by way of illustration and not limitation.

What is claimed is:

1. In a stove, the stove having a firebox with oppositely disposed front and rear walls, the stove also having an exhaust port and an adjustable damper mechanism operatively associated therewith, the damper mechanism being manually movable between open and closed positions, an improved damper adjusting mechanism comprising:

damper adjustment rod means, said rod means being attached at a first end to the damper and having a second end extending through a hole in the front wall of the stove, said rod means being capable of moving in a first and second direction so as to open and close the damper mechanism, said second end of said rod means having a plurality of notches thereon, said notches being of a larger width than the width of the second wall of the stove, said rod means retained in position by engaging said notches onto the second wall of the stove; and creosote shield means, said shield means being within the stove, said shield means being secured to the second wall of the stove, said shield means partially encompassing said second end of said rod means.

2. The apparatus of claim 1 wherein the said creosote shield means is of rectangular form, said shield means and said rod means being coaxial.

3. The apparatus of claim 2 wherein said shield means is arranged such that two opposite corners define a horizontal plane and the two other corners define a vertical plane.

4. The apparatus of claim 3 wherein the said shield means has sufficient length and is positioned so as to encompass that portion of said rod means that has the plurality of notches thereon.

5. The apparatus of claim 4 wherein said shield means is secured to the second wall of the stove by welding.

* * * * *